US005133138A

United States Patent [19]

Durcho

[11] Patent Number: 5,133,138

[45] Date of Patent: Jul. 28, 1992

[54] REPLACEABLE HIGH HEEL

[76] Inventor: Mark C. Durcho, 513 Orange Blossom La., Nokomis, Fla. 34275

[21] Appl. No.: 719,163

[22] Filed: Jun. 21, 1991

Related U.S. Application Data

[63] Continuation-in-part of Ser. No. 644,325, Jan. 22, 1991.

[51] Int. Cl.[5] ..... A43B 21/36

[52] U.S. Cl. ..... 36/36 R; 36/34 R; 36/100

[58] Field of Search ..... 36/34 R, 36 R, 36 A, 36/36 B, 36 C, 41, 42, 100, 101

[56] References Cited

U.S. PATENT DOCUMENTS 3,193,949 7/1965 Cortina ..... 36/42

4,805,320 2/1989 Goldenberg et al. ..... 36/36 R X

*Primary Examiner*—Paul T. Sewell

*Assistant Examiner*—BethAnne Cicconi

*Attorney, Agent, or Firm*—Dominik, Stein, Saccocio, Reese, Colitz, & Van Der Wall

[57] ABSTRACT

For use with a shoe having an upper and a sole and with a block downwardly extending from the lower portion of the sole adjacent to the heel and with a magnetic plate facing downwardly from the block, an improved replaceable heel having an upper surface with an upwardly facing recess therein and a magnetically responsive plate face upwardly on the lower surface of the recess.

4 Claims, 3 Drawing Sheets

REPLACEABLE HIGH HEEL

BACKGROUND OF THE INVENTION

This application is a continuation-in-part application of U.S. patent application Ser. No. 07/644,325 filed Jan. 22, 1991.

FIELD OF THE INVENTION

This invention relates to a replaceable high heel, and, more particularly, to a shoe having a sole with a magnetic plate on a downwardly extending block and having a heel with a magnetically responsive plate facing upwardly within a recess for removably coupling a high heel on a shoe.

DESCRIPTION OF THE BACKGROUND ART

In the field of footwear, it is common for shoes to be provided with heels which are replaceable. Replaceable heels are not uncommon for shoes cf males. The replacement of heels allows for a user to change the heel whenever the heel becomes worn through extended use. A new heel presents a better appearance and also abates the problem of walking on an uneven surface. Replacement of heels after extended use is normally done only once or a few times a year, at most, depending on usage of the shoe.

Replacement of heels of ladies' shoes, wherein the heels are high with respect to width, is less common than for men's shoes. This is true even though the need for replaceable high heels is greater than the need for replaceable low heels. Replaceable high heels for ladies' shoes, in addition to correction for wear, allows for changes in appearance. Replaceable high heels for ladies' shoes must be securely coupled to the sole portion of the shoe from a structural standpoint. From a functional standpoint, replaceable high heels will allow for changes in appearance through changes of heel color, texture, design, height, etc. This is of increasing importance with the emphasis on appearance of the wearer.

The present invention is directed to improving known devices for coupling heels to shoes in a manner which is safe, secure, convenient, economical and aesthetically pleasing.

The prior art discloses several types of connectors between heels and soles of shoes. By way of example, U.S. Pat. Nos. 1,482,763 to O'Neill and 3,068,592 to Antelo disclose men's shoes with replaceable heels. A plurality of specially designed fastener components are individually secured into the lower portion of a shoe sole. The lower portions of the fastener components are located in recesses of the heels of the shoes. The O'Neill device requires special fasteners and special heels. Alignment and coupling are solely dependent upon the fasteners. In Antelo, a central cross-shaped member extends upwardly from the heel for being received in a similarly shaped recess in the lower portion of the sole. Snap-like fastener components extend upwardly for being coupled in specifically sized recesses surrounding the cross-shaped member. In both O'Neill and Antelo, the coupling is between a heel and shoe of a man's shoe wherein the width is much greater than the height of the heel and wherein alignment is difficult due to the plurality of components which must be aligned.

Other male shoes with heel connecting components which are complex in design and difficult to operate include U.S. Pat. Nos. 2,403,592 to Fisk; 2,932,099 to Dardig; 4,014,115 to Reichert, and 4,409,745 to Musci.

Additional replaceable high heels are shown in U.S. Pat. Nos. 2,320,584 to Giesser and 4,805,320 to Goldenberg. These last two patents require complex mechanical couplings with joining or unjoining movements either axially or radially with respect to the axis of the heel in order to effect coupling. The coupling mechanisms are of excessively high cost and of marginal convenience.

Lastly, U.S. Pat. No. 3,977,095 to Phillips illustrates an additional disclosure of a replaceable woman's high heel. This device primarily consists of a magnetic spool which is embedded within the heel of a woman's shoe. The magnetic spool serves to removably receive an extending magnetic rod of a heel extension. Furthermore, the heel extension may be carried in a woman's use when not in use.

None of these prior art patents teaches or suggests the safe, secure, convenient, economical and aesthetically pleasing arrangement of coupling of heels to shoes as described herein. Known devices are simply lacking in one regard or another.

As illustrated by the great number of prior art patents, and known commercial devices, efforts are continuously being made to removably couple heels to shoes. None of these prior art efforts, however, suggests the present inventive combination of component elements arranged and configured as disclosed and claimed herein. Prior efforts do not provide the benefits attendant with the present invention. The present invention achieves its purposes, objectives and advantages over the prior art devices through a new, useful and unobvious combination of component elements, through the use of a minimum number of functioning parts, at a reduction in cost to the manufacture, and through the utilization of only readily available materials and conventional components.

It is, therefore, an object of the present invention to provide a shoe having an upper and a sole and with a block downwardly extending from the lower portion of the sole adjacent to the heel and with a magnetic plate facing downwardly from the block, an improved replaceable heel having an upper surface with an upwardly facing recess therein and a magnetically responsive plate face upwardly on the lower surface of the recess.

It is a further object of the present invention to magnetically couple heels to shoes in a removable manner which is safe, secure and convenient for the user.

It is a further object of the invention to manufacture replaceable heels economically.

It is a further object of the present invention to allow a wearer of shoes to change the heel to suit the user's desire and render the wearer's appearance aesthetically pleasing.

It is a further object of the present invention to coordinate the heel of a shoe with the remainder of the wearer's apparel for the sake of fashion.

These objects and advantages should be construed as merely illustrative of some of the more prominent features and applications of the present invention. Many other beneficial results can be obtained by applying the disclosed invention in a different manner or by modifying the invention within the scope of the disclosure. Accordingly, other objects and advantages, as well as a fuller understanding of the invention, may be had by referring to the summary and detailed description of the preferred embodiment of the invention in addition to the scope of the invention as defined by the appended claims taken in conjunction with the accompanied drawings.

SUMMARY OF THE INVENTION

The present invention is defined by the appended claims with the specific preferred embodiment shown in the attached drawings. for the purpose of summarizing the invention, the invention may be incorporated into an improved shoe which includes a shoe having an upper and a sole and with a block downwardly extending from the lower portion of the sole adjacent to the heel and with a magnetic plate facing downwardly from the block, an improved replaceable heel having an upper surface with an upwardly facing recess therein and a magnetically responsive plate face upwardly on the lower surface of the recess.

The recess and the block have planar walls of complimentary size and shape to guide the coupling of the plates. The apparatus further includes a flange on each of the plates provided for securing the plates onto the block and the surface. The apparatus further includes a hollow casing located in the heel extending from the recess to exterior of the heel. The apparatus further includes an aperture extending from the forward surface of the block to an intermediate portion of the block, the aperture being in alignment with the casing and with the lower surface of the aperture formed by upper surface of the magnetic plate. The apparatus further includes a magnetically responsive lock pin in the casing and reciprocable between a release position remote from the block and a lock position in the aperture in contact with the magnetic plate. The apparatus further includes a magnetically responsive lock pin in the casing and reciprocable between a release position remote from the block and a lock position in the aperture in contact with the magnetic plate.

The invention may also be incorporated into a shoe comprising an upper, a sole and a heel, the heel having an upper surface with an upwardly facing recess; a plate secured on the lower surface of the recess; a hollow casing extending between the recess and exterior of the heel; a magnetically responsive lock pin axially reciprocable within the casing; the sole having a downwardly extending block adjacent to the heel; a plate located on the lower surface of the block, one of the plates being a magnet and the other being magnetically responsive; and an aperture in the block in alignment with the casing for receiving the pin when in a locked position, the recess and the block have planar walls of complimentary size and shape to guide in coupling of the plates.

The foregoing has outlined rather broadly some of the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiment disclosed herein may be readily utilized as a basis for modifying or designing other structures for carrying out the same purposes of the present invention. It should be appreciated by those skilled in the art that such equivalent structures do not depart from the spirit and scope of the present invention as set forth in the appended claims.

BRIEF DESCRIPTION OF THE DRAWINGS

For a more complete understanding of the nature object and advantages of the present invention, reference should be had to the following detailed description taken in conjunction with the accompanying drawings in which.

Similar reference numerals refer to similar parts throughout the several figures.

DETAILED DESCRIPTION OF THE INVENTION

Figure 1:
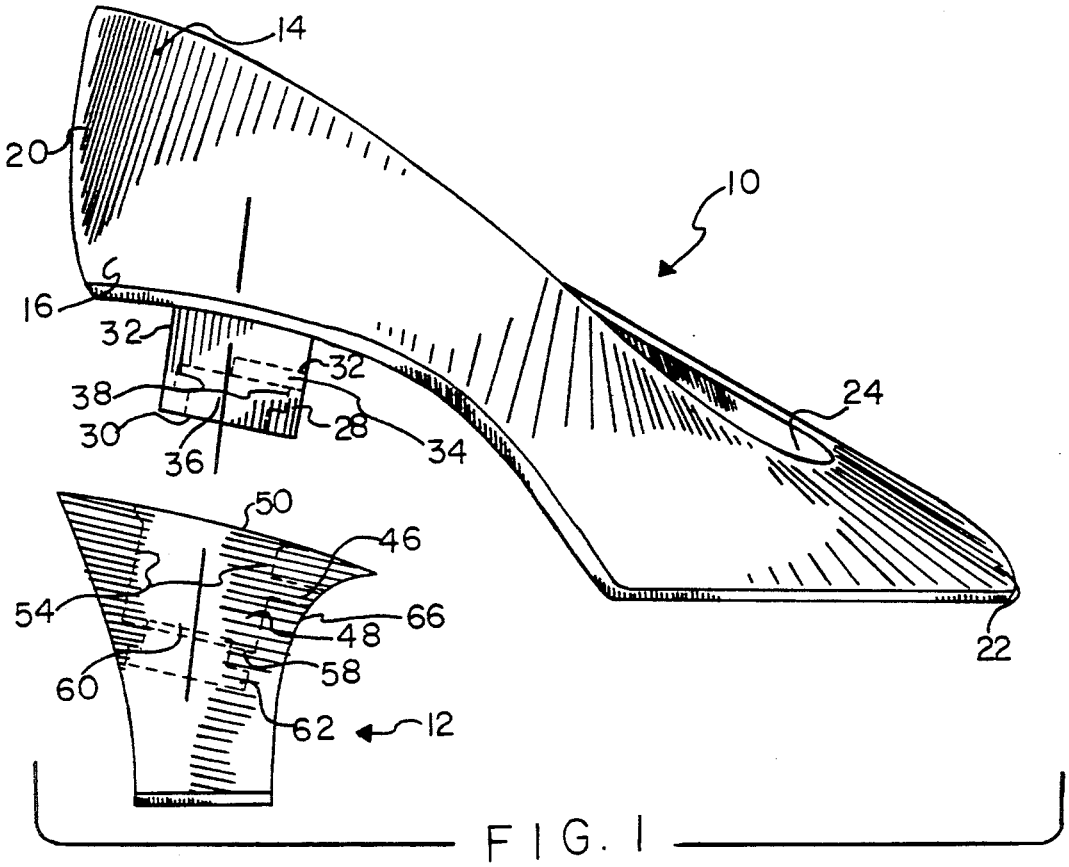
FIG. 1 is a side elevational view of a ladies' high heel shoe employing a replaceable heel of the present invention with the heel removed to show certain internal constructions thereof.
Figure 2:
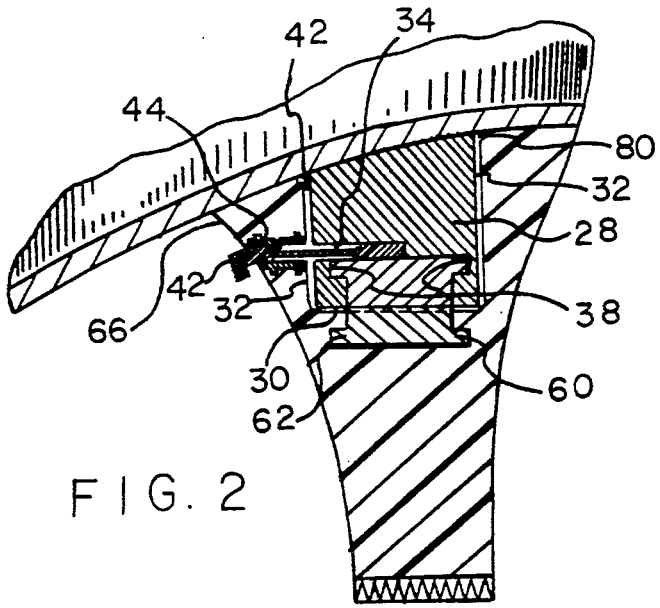
FIG. 2 is an enlarged sectional view of a portion of the shoe and the replaceable heel shown in FIG. 1 taken along the axis of the heel.
Figure 3:
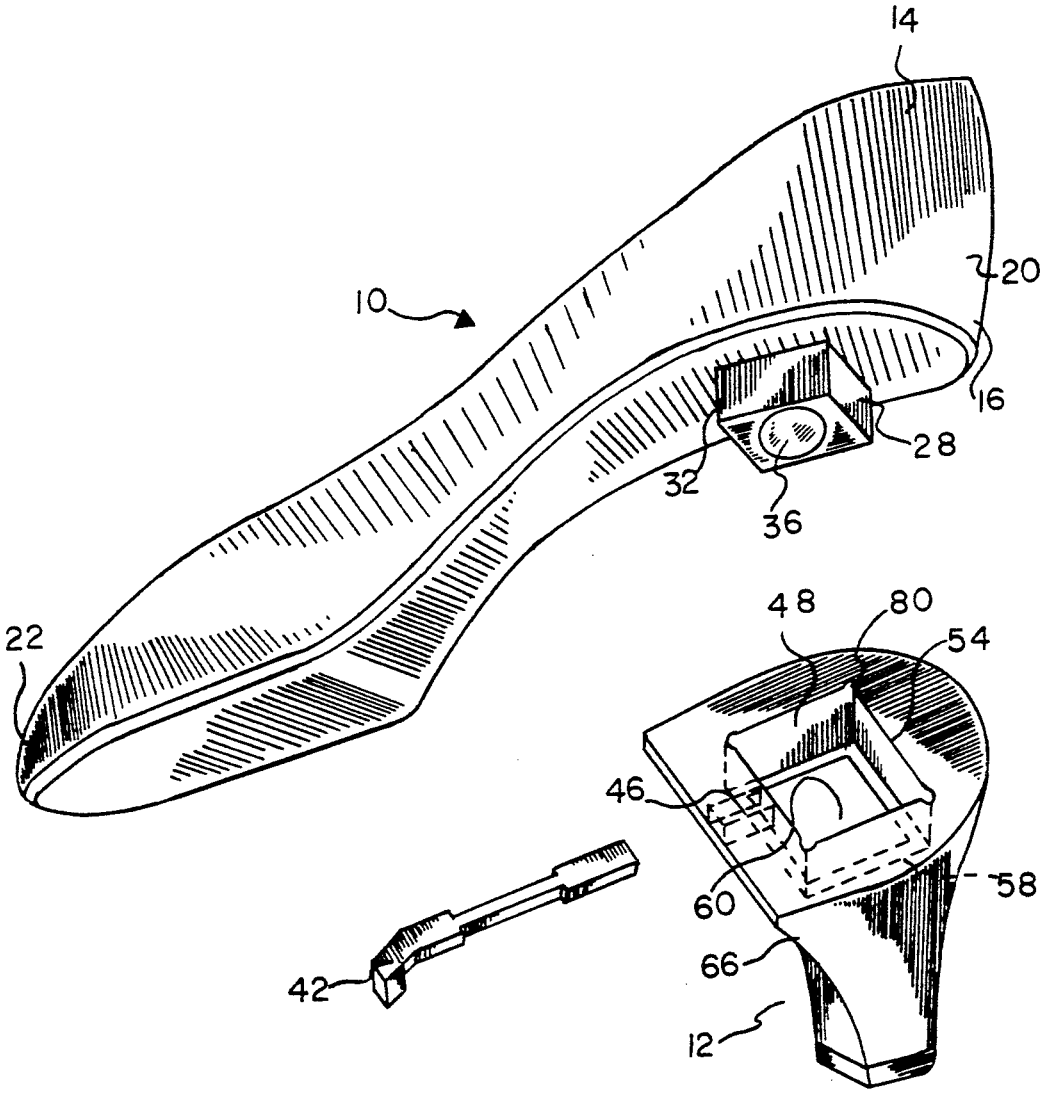
FIG. 3 is an exploded view taken in perspective of the heel and a portion of the shoe shown in FIGS. 1 and 2.
Figure 4:
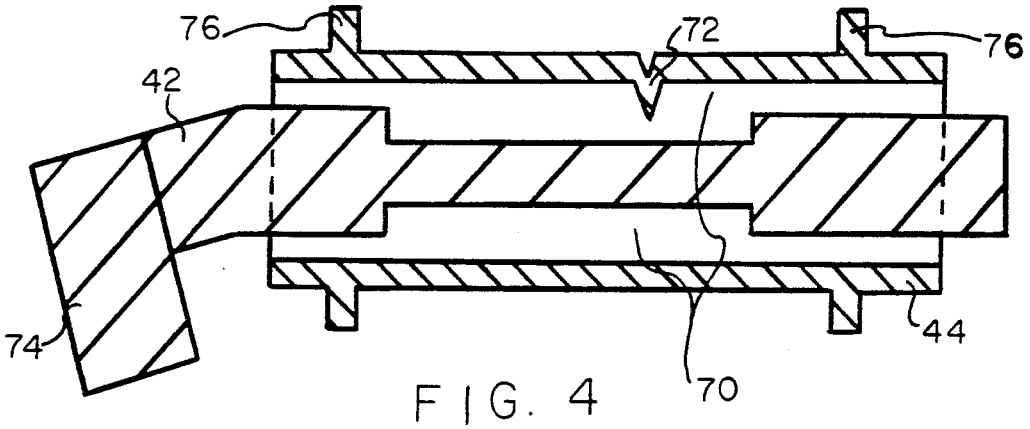
FIG. 4 is an enlarged axially sectional view of the hollow casing relating to the lock pin.
Figure 5:
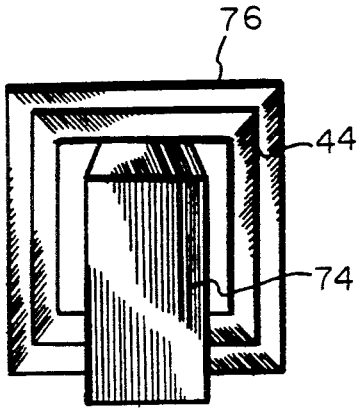
FIG. 5 is an end view of the hollow casing and lock pin taken from the left end of FIG. 4 showing the pin in the hollow casing from a position facing the forward exterior face of the removable heel.
Figure 6:
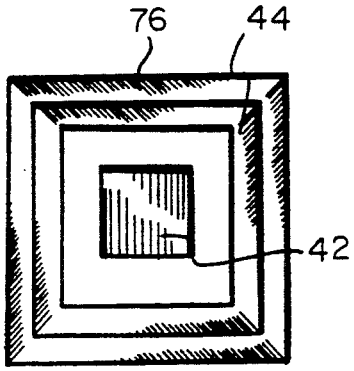
FIG. 6 is an end view of the replaceable heel taken from the right end of FIG. 4 illustrating the upwardly facing recess and the magnetically responsive plate located on the lower surface of the recess.
Figure 7:
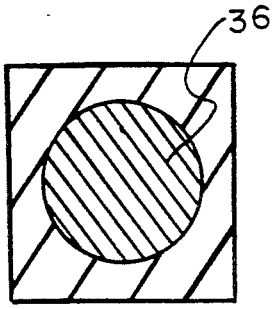
FIG. 7 is a plan view of the magnetically responsive plate illustrating the flanges that secure the plate to the block.
Figure 8:
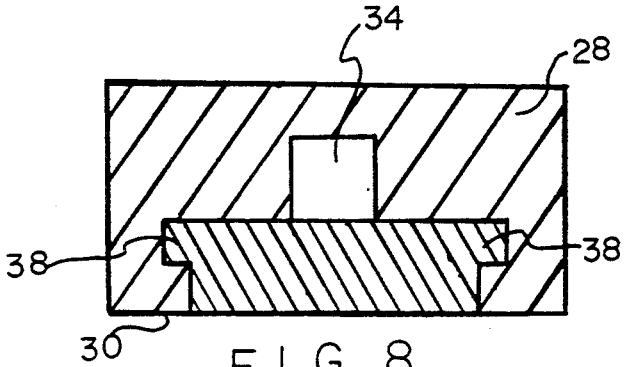
FIG. 8 is a cross-sectional view of the block downwardly extending from the lower portion of the sole adjacent to the heel showing the magnetic plate and aperture.

Shown in the various FIGS. 10 is a shoe with a replaceable heel 12 constructed in accordance with the principles of the preferred embodiment of the present invention.

The shoe 10 includes an upper 14 and a sole 16 adapted to receive the wearer's foot therebetween. A heel 12 is removably secured to the rearward extent of the upper 14 beneath the sole. The shoe as well as the upper includes a heel portion 20 and a toe portion 22 spaced from the heel portion. The heel portion 20 of the upper and shoe are provided with an opening 24 at the upper extent through which the wearer may insert and remove her foot for putting on and taking off the shoe 10. Along the lower extent of the upper is the sole. The sole is a relatively rigid component for protecting the wearer's foot. It is also slightly flexible so as to bend with the natural bending of the wearer's foot during walking. In these regards, the shoe is conventional in its construction except for its heel and mechanisms for its coupling to the rearward extent of the sole.

Located in the lower block surface 30 is an aperture 34. Centrally located in the lower surface of the block is a magnetic plate 36. Located at the rearward extent of the sole and extending downwardly therefrom is a block 28. The lower surface of the block 28 is generally planar. Extending generally vertically on the block are sidewalls 32 of a planar configuration. The block is generally shaped in the form of a cube with a rectangular cross section.

Centrally located on the lower surface of the block is the magnetic plate 36. The shape of the plate is a generally flat, round disk. Flanges 38 are provided on the plate to prevent the plate from being inadvertently released from the block.

Further, the aperture 34 on the forward surface of the downwardly extending block extends from the forward surface of the block to an intermediate portion of the block. The aperture 34 has a rectangular cross section and is sized and located to accepting a lock pin 42 with a rectangular cross section that passes through a hollow casing 44 in the forward wall of the removable heel 12. The casing 44 is located in an opening 46 in the heel in alignment with the aperture 34. The inner surface of the casing and the outer surface of the lock pin therein are of circular or cross sectional configurations. Additionally, the lower surface of the aperture 34 is formed by the top surface of the centrally located magnetic plate 36 in the block.

Positionable to cooperate with the block 28 and magnetic plate 36 is the upper portion of the heel 12. The upper portion of the heel is provided with a downwardly directed, upwardly facing, recess 48 with an opening 50 at its upper extent. The recess 48 has planar sidewalls 54 in a rectangular configuration of a size and location to be received securely by the downwardly directed sidewalls 32 of the block 28. In this manner, when the heel 12 is placed in operative communication with the block 28, rotational movement therebetween is essentially precluded. Further, the cooperation and mating of the sidewalls of the block and recess are such as to abate rotation of the heel with respect to the block in a direction perpendicular to the axis of the heel. This further ensures a coupling between the heel and the remainder of the shoe.

The recess 48 in the heel 12 has a surface 58 at its lower extent. Centrally located on the surface of the heel is an upwardly facing magnetically responsive fastener plate 60. The upwardly facing magnetically responsive plate is generally a flat, square shape with flanges 62. The flanges formed in the plate secure the plate to the heel 12. The flanges also prevent the heel from inadvertently releasing the plate.

A hollow lock pin casing 44 is located in the forward wall 66 of the heel. The casing 44 extends from the recess to exterior of the heel. The lock pin 42 is magnetically responsive and is located in the casing 44 and is capable of entering the aperture 34 on the block 28.

The lock pin has a recess 70 along a central portion of its length. A projection 72 formed in the casing 44 extends into the recess to define the extent of movement of the pin into the block for locking and out of the block for heel removal. The external end of the lock pin 42 has a finger 74 to assist the wearer in engaging and disengaging the lock pin and heel. In addition, flanges 76 ensure secure retention of the casing 44 in the heel.

Mounting of the heel on the sole involves the heel being located with its recess walls in sliding contact with the walls of the block. The heel may then be slid axially so that the opposing magnetic-fasteners 36 and 60 come into contact. After this occurs, the lock pin 42 is axially shifted within the casing 44 to penetrate the aperture 34 in the downwardly extending block 28. When the lock pin 42 is in the locked position, the pin contacts the upper surface of the magnetic plate 36. The pin is additionally securely held in the locked position by the magnetic plate. This holds up the heel securely with regard to the remainder of the shoe. Removal of the heel from the sole is effected by the reversing of these steps.

The walls of the block and the recess are wider than they are high. In the preferred embodiment as shown, the block and recess walls are about $\frac{1}{2}$ inch high and about $\frac{7}{8}$ inches in width and length in a square configuration. A non-square configuration such as a rectangle is acceptable. A most secure coupling is thus created. The closeness of the adjacent walls of the block and recess allows for frictional contact when walking to further insure the coupling of the heel to the shoe for increased safety.

In association with the recess are a plurality of generally vertically extending corner recesses 80, parallel with each other, located at each corner of the recess 48. These corner recesses allow for the flow of air into and out of the recess during putting a new heel on and taking an old heel off.

The heel and block are preferably made of a one piece molded construction of a rigid thermo plastic or thermosetting polymer. Polystyrene is preferred. By molding the heel as one piece, provisions for accepting the magnetically responsive plate flanges may be formed integrally therewithin for the greatest amount of structural integrity. In the alternative, the means to secure the magnetic plate may be molded separately from the remainder of the heel and attached thereto as by nails, screws, or adhesive. The one piece molding, however, is preferred.

It is preferred that a recess to accept the magnetically responsive plate flanges be fabricated integrally with the downwardly extending block. The block may also be formed integrally with the heel. In the alternative, other conventional forms of coupling, as for example screws or an adhesive, may readily be utilized as is common in the shoe industry.

With this arrangement, a wearer may easily change heels for maximum aesthetic pleasure. Such different heels may be of different heights, color, texture, etc. The differences may be effected during the molding or other fabrication process. In the alternate, differences of appearance may singly be done to the exterior surfaces of the heels.

The present disclosure includes that information contained in the appended claims as well as that in the foregoing description. Although the invention has been described in its preferred form or embodiment with a certain degree of particularity, it is understood that the present disclosure of the preferred form has been made by way of example only and that numerous changes in the details of construction, fabrication and use including combination and arrangement of parts, may be resorted to without departing from the spirit and scope of the invention.

Now that the invention has been described,

What is claimed:

1. For use with a shoe having an upper and a sole and with a block having planar walls downwardly extending from the lower portion of the sole adjacent to the heel and with a magnetic plate facing downwardly from the block, an improved replaceable heel having an upper surface with an upwardly facing recess therein and a magnetically responsive plate facing upwardly on the lower surface of the recess, the heel also including a hollow casing extending from the recess to a location exterior of the heel in alignment with an aperture extending from one surface of the block to an internal position of the block and with one surface of the aperture formed by one surface of the magnetic plate, the heel further including a magnetically responsive lock pin in the casing adapted to reciprocate between a release position remote from the block and a lock position in the aperture in contact with the magnetic plate in the block.

2. The improved replaceable heel as set forth in claim 1 wherein the recess has planar walls of size and shape corresponding to planar walls of the block to guide the coupling of the magnetically responsive plate with the magnetic plate.

3. The improved replaceable heel as set forth in claim 1 and further including a flange on the magnetically responsive plate for securement to the lower surface of the recess.

4. A shoe comprising an upper, a sole and a heel, the heel having an upper surface with an upwardly facing recess, the recess having side walls and a lower surface; a plate secured on the lower surface of the recess; a hollow casing extending through the heel between the recess and a location exterior of the heel; a magnetically responsive lock pin axially reciprocable within the casing; the sole having a downwardly extending block adapted to be received in the recess of the heel, the block having side walls and a lower surface; a plate located on the lower surface of the block, one of the plates being a magnet and the other being magnetically responsive; and an aperture in the block in alignment with the casing for receiving the pin when in a locked position, the pin being magnetically retained in the locked position by the magnet, with the side walls of the recess and the block being of a size and shape to guide in coupling of the plates.

* * * * *